US009814649B1

(12) United States Patent
Meyers

(10) Patent No.: US 9,814,649 B1
(45) Date of Patent: Nov. 14, 2017

(54) ARCUATE TACTILE SIDEWALK TILE ARRANGEMENT AND METHOD OF ASSEMBLY

(71) Applicant: TUF-TITE, INC., Lake Zurich, IL (US)

(72) Inventor: Theodore W. Meyers, Barrington, IL (US)

(73) Assignee: TUF-TITE, INC., Lake Zurich, IL (US)

( * ) Notice: Subject to any disclaimer, the term of this patent is extended or adjusted under 35 U.S.C. 154(b) by 0 days.

(21) Appl. No.: 15/692,932

(22) Filed: Aug. 31, 2017

Related U.S. Application Data

(63) Continuation of application No. 15/059,902, filed on Mar. 3, 2016, now Pat. No. 9,770,383.

(60) Provisional application No. 62/132,913, filed on Mar. 13, 2015.

(51) Int. Cl.
*E01C 9/00* (2006.01)
*A61H 3/06* (2006.01)
*E01C 15/00* (2006.01)

(52) U.S. Cl.
CPC ..... *A61H 3/066* (2013.01); *E01C 9/00* (2013.01); *E01C 15/00* (2013.01)

(58) Field of Classification Search
CPC ..... A61H 3/066; E01C 9/00; E01C 15/00
USPC ..... 404/34–36
See application file for complete search history.

(56) References Cited

U.S. PATENT DOCUMENTS 2,153,347 A 4/1939 Schenck
3,418,781 A 12/1968 Penote
3,950,908 A 4/1976 Van Eyk
4,080,087 A 3/1978 Phillips
4,468,910 A 9/1984 Morrison
4,490,069 A 12/1984 Cushman et al.
4,674,251 A 6/1987 Wolff
4,715,743 A 12/1987 Schmanski
5,217,319 A 6/1993 Klohn
5,271,690 A 12/1993 Fennessy, Sr.
5,281,459 A 1/1994 Van Eijck
5,302,049 A 4/1994 Schmanski
5,303,669 A 4/1994 Szekely
5,320,790 A 6/1994 Lowe
5,616,650 A 4/1997 Becker et al.
(Continued)

FOREIGN PATENT DOCUMENTS

GB 379690 A 8/1932
GB 433732 A 8/1935
GB 486128 A 5/1938

OTHER PUBLICATIONS

Engineered Plastics, Inc.'s Drawing No. ADA-C-1212 published on Engineered Plastics' website at least as early as Apr. 2004.
(Continued)

*Primary Examiner* — Raymond W Addie
(74) *Attorney, Agent, or Firm* — Marshall, Gerstein & Borun LLP

(57) ABSTRACT

An arcuate tactile sidewalk tile arrangement includes a connector tactile sidewalk tile including a wedge-shaped main body and one or more connector flanges that adjoin one or more longitudinal sides of the wedge-shaped main body. One or more rectilinear tactile sidewalk tiles overlap the one or more connector flanges. A plurality of truncated domes projects upwardly in a vertical direction from an upper surface of the wedge-shaped main body, as well as an upper surface of each one of the one or more rectilinear tactile sidewalk tiles.

20 Claims, 8 Drawing Sheets

(56) References Cited

U.S. PATENT DOCUMENTS

| | | | |
|---|---|---|---|
| 5,637,641 | A | 6/1997 | Becker et al. |
| 5,733,997 | A | 3/1998 | Becker et al. |
| 5,741,878 | A | 4/1998 | Becker et al. |
| 5,750,628 | A | 5/1998 | Becker et al. |
| 5,767,218 | A | 6/1998 | Becker et al. |
| 5,775,835 | A | 7/1998 | Szekely |
| 5,807,954 | A | 9/1998 | Becker et al. |
| 5,827,009 | A | 10/1998 | Kokoletsos |
| 5,840,396 | A | 11/1998 | Betz |
| 5,907,934 | A | 6/1999 | Austin |
| 5,927,034 | A | 7/1999 | Cole |
| 6,153,282 | A | 11/2000 | Dickinson et al. |
| 6,273,657 | B1 | 8/2001 | Vorona |
| 6,449,790 | B1 | 9/2002 | Szekely |
| 6,450,728 | B1 | 9/2002 | Grahmbeek et al. |
| 6,699,553 | B1 | 3/2004 | Koket |
| 6,709,191 | B1 | 3/2004 | McCuskey |
| 6,718,714 | B1 | 4/2004 | Montgomery, Sr. |
| 6,740,388 | B1 | 5/2004 | Koket |
| 6,802,159 | B1 | 10/2004 | Kotler |
| 6,890,124 | B2 | 5/2005 | Provenzano, III |
| 6,895,622 | B2 | 5/2005 | Szekely |
| 6,939,078 | B1 | 9/2005 | Anderson et al. |
| 6,960,989 | B1 | 11/2005 | Grayson |
| 6,964,244 | B2 | 11/2005 | Stockton |
| 6,971,818 | B1 | 12/2005 | Schabacker |
| 7,000,279 | B2 | 2/2006 | Szekely |
| 7,000,361 | B1 | 2/2006 | Merriman et al. |
| 7,001,103 | B2 | 2/2006 | Sippola |
| 7,114,298 | B2 | 10/2006 | Kotler |
| 7,121,048 | B1 | 10/2006 | Merriman et al. |
| 7,182,548 | B1 | 2/2007 | Womack |
| 7,189,025 | B1 | 3/2007 | Greer et al. |
| 7,223,048 | B1 | 5/2007 | Greer et al. |
| 7,249,911 | B2 | 7/2007 | Hyams |
| 7,267,281 | B2 | 9/2007 | Hopkins |
| 7,346,865 | B2 | 3/2008 | Su et al. |
| 7,608,313 | B2 | 10/2009 | Solomon et al. |
| 7,674,066 | B2 | 3/2010 | Wehmeyer |
| 7,758,279 | B2 | 7/2010 | Driscoll |
| 7,779,581 | B2 | 8/2010 | Flaherty et al. |
| 7,845,122 | B2 | 12/2010 | Sippola |
| 7,908,802 | B2 | 3/2011 | Frederiksen |
| 7,992,360 | B2 | 8/2011 | Driscoll |
| 7,993,074 | B1 | 8/2011 | Driscoll |
| 8,028,491 | B2 | 10/2011 | Flaherty et al. |
| 8,122,670 | B2 | 2/2012 | Matthee |
| 8,146,302 | B2 | 4/2012 | Sippola |
| D691,743 | S | 10/2013 | Meyers |
| D700,369 | S | 2/2014 | Meyers |
| 8,920,066 | B1 | 12/2014 | Meyers |
| 9,311,831 | B2 | 4/2016 | Henshue et al. |
| 9,322,162 | B2 | 4/2016 | Olofsson et al. |
| 2003/0037720 | A1 | 2/2003 | Stockton |
| 2003/0084523 | A1 | 5/2003 | Szekely |
| 2004/0042850 | A1 | 3/2004 | Provenzano |
| 2004/0067336 | A1 | 4/2004 | Munroe |
| 2005/0013662 | A1 | 1/2005 | Provenzano |
| 2005/0031415 | A1 | 2/2005 | Sippola |
| 2005/0066623 | A1 | 3/2005 | Sippola |
| 2005/0144743 | A1 | 7/2005 | Szekely |
| 2005/0265782 | A1 | 12/2005 | Everett |
| 2006/0024132 | A1 | 2/2006 | Seman |
| 2006/0037155 | A1 | 2/2006 | Szekely |
| 2006/0039752 | A1 | 2/2006 | Hyams |
| 2006/0108426 | A1 | 5/2006 | Hopkins |
| 2006/0174567 | A1 | 8/2006 | Sippola |
| 2006/0188680 | A1 | 8/2006 | Everett |
| 2006/0210766 | A1 | 9/2006 | Press et al. |
| 2006/0227009 | A1 | 10/2006 | Koehn |
| 2006/0245827 | A1 | 11/2006 | Rydin et al. |
| 2007/0059441 | A1 | 3/2007 | Greer |
| 2007/0086859 | A1 | 4/2007 | Julnes |
| 2007/0092335 | A1 | 4/2007 | Wehmeyer |
| 2007/0196169 | A1 | 8/2007 | Logan et al. |
| 2007/0201949 | A1 | 8/2007 | Veldboom et al. |
| 2007/0212190 | A1 | 9/2007 | Monday et al. |
| 2007/0269264 | A1 | 11/2007 | Boghossian |
| 2008/0008526 | A1 | 1/2008 | Boghossian |
| 2008/0229703 | A1 | 9/2008 | Driscoll |
| 2008/0280097 | A1 | 11/2008 | Flaherty et al. |
| 2010/0313502 | A1 | 12/2010 | Flaherty et al. |
| 2011/0185961 | A1 | 8/2011 | Flaherty et al. |
| 2012/0017823 | A1 | 1/2012 | Flaherty et al. |
| 2012/0073492 | A1 | 3/2012 | Flaherty et al. |
| 2012/0076579 | A1 | 3/2012 | Flaherty et al. |
| 2012/0076580 | A1 | 3/2012 | Flaherty et al. |
| 2012/0124936 | A1 | 5/2012 | Flaherty et al. |
| 2012/0207543 | A1 | 8/2012 | Sippola |
| 2015/0173995 | A1 | 6/2015 | Bub |

OTHER PUBLICATIONS

Engineered Plastics, Inc.'s Drawing No. ADA-P044-BA4-24M published on Engineered Plastics' website at least as early as May 2001.

Engineered Plastics, Inc.'s Drawing No. ADT-S203-GEN2-06X48 published on Engineered Plastics' website at least as early as May 2001.

ARCUATE TACTILE SIDEWALK TILE ARRANGEMENT AND METHOD OF ASSEMBLY

CROSS-REFERENCE TO RELATED APPLICATION

This application is a continuation application claiming the priority benefit of U.S. patent application Ser. No. 15/059,902, filed Mar. 3, 2016, now U.S. Pat. No. 9,770,383, which claims the priority benefit of U.S. Provisional Patent Application No. 62/132,913, filed Mar. 13, 2015. The entire contents of U.S. patent application Ser. No. 15/059,902 and U.S. Provisional Patent Application No. 62/132,913 are expressly incorporated herein by reference.

FIELD OF THE DISCLOSURE

This disclosure relates generally to an embedded sidewalk tile and, more particularly, to a tactile sidewalk tile for detection by visually impaired pedestrians.

BACKGROUND OF THE DISCLOSURE

The Americans with Disabilities Act (ADA) requires the installation of tactile warning surfaces in certain location to alert blind and other visually impaired pedestrians of potential hazards. Common locations for tactile warning surfaces include hazardous vehicular areas (e.g., intersections, street corners, and uncurbed transitions between pedestrian and vehicular areas) and areas having sudden drop-offs (e.g., train platforms and loading docks).

A tactile warning surface is typically formed by one or more tactile sidewalk tiles having a pattern of raised truncated domes and smaller pointed nubs. The tactile sidewalk tiles are placed over wet concrete so that an underside of the tactile sidewalk tile bonds to the concrete underlayer. The raised truncated domes and smaller pointed nubs provide tactile cues (e.g., through a sole of a shoe, through a sweeping cane, through a wheelchair wheel, or through a walker wheel) that alert the visually impaired pedestrian of the hazardous area ahead. The tactile sidewalk tile may also provide a visual cue (e.g., color contrast with the surrounding concrete) and/or an audio cue (e.g., sound attenuation caused by dissimilar materials used for the tactile sidewalk tile and the sidewalk).

While many intersections have sidewalks that meet a road surface at a single edge, for which a linear array of two or more rectangular (e.g., square) tactile tiles is appropriate, a rounded sidewalk corner, such as one that serves two perpendicular cross-walks or permits pedestrians to walk diagonally across an intersection, presents a situation for which an arcuate tactile warning surface that follows the inside of the rounded sidewalk corner would be appropriate. Conventional tactile sidewalk tiles typically have a rectilinear shape (e.g., square or rectangular). Many installers of tactile warning surfaces when faced with rounded sidewalk corners opt to arrange a plurality of rectangular tactile tiles along the curve of the sidewalk, but this undesirably leaves wedge-shaped gaps between the tactile tiles, which gaps are occupied by cementitious material or asphalt, and are free of any raised truncated domes. Such an arrangement also prevents the installer from pre-connecting a plurality of tactile tiles prior to installation, instead requiring that each tactile tile be installed independently.

Some have offered labor-intensive solutions to providing a more continuous arrangement of raised truncated domes along such rounded-corner sidewalks, involving providing a rectangular tactile tile with score lines that can be used to facilitate removal of portions of the rectangular tile until only a wedge-shaped region of the tactile tile remains. Such cut-down wedge-shaped tactile tiles are arranged between rectangular tactile tiles such that the array of rectangular and wedge-shaped tiles can then more closely mimic the rounded corner of the sidewalk. Therefore, to construct an arcuate tactile warning surface, it may be necessary to cut or otherwise modify one or more rectilinear tactile sidewalk tiles to form an arcuate shape. Re-shaping a tactile sidewalk tile in this manner is time-consuming and may require the use of a utility knife or even a motorized saw tool, particularly if the tactile sidewalk tile is made of metal or another strong material. In some cases, it may be necessary to cut the rectilinear tactile sidewalk tile at the installation site, without the assistance of measuring tools. As a result, it can be difficult to form an array of tactile sidewalk tiles with the proper curvature.

SUMMARY OF THE DISCLOSURE

One aspect of the present disclosure includes an arcuate tactile sidewalk tile arrangement including a connector tactile sidewalk tile, a first rectilinear tactile sidewalk tile, and a second rectilinear tactile sidewalk tile. The connector tactile sidewalk tile may include a wedge-shaped main body and first and second connector flanges that adjoin opposite sides of the wedge-shaped main body. The first rectilinear tactile sidewalk tile may overlap the first connector flange, and the second rectilinear tactile sidewalk tile may overlap the second connector flange. A plurality of truncated domes may project upwardly in a vertical direction from an upper surface of the first rectilinear tactile sidewalk tile, an upper surface of the first rectilinear tactile sidewalk tile, and an upper surface of the second rectilinear tactile sidewalk tile.

Another aspect of the present disclosure provides a connector tactile sidewalk tile including a wedge-shaped main body and a plurality of truncated domes which project upwardly in a vertical direction from an upper surface of the wedge-shaped main body. The connector tactile sidewalk tile may also include a first connector flange and a second connector flange that adjoin opposite sides of the wedge-shaped main body. The first connector flange may be step down from the wedge-shaped main body such that an upper surface of the first connector flange is offset downwardly in the vertical direction from the upper surface of the wedge-shaped main body. The second connector flange may also be step down from the wedge-shaped main body such that an upper surface of the second connector flange is offset downwardly in the vertical direction from the upper surface of the wedge-shaped main body. The offset of the upper surface of the first connector flange from the upper surface of the wedge-shaped main body is preferably the same as the offset of the second connector flange from the wedge-shaped main body. Preferably, the first and second connector flanges have the same thickness as one another.

Yet another aspect of the present disclosure provides a method of assembling an arcuate tactile sidewalk tile arrangement. The method includes providing a connector tactile sidewalk tile including a wedge-shaped main body, first and second connector flanges that adjoin opposite sides of the wedge-shaped main body, and a plurality of truncated domes that project upwardly in a vertical direction from an upper surface of the wedge-shaped main body. The method further includes positioning a first rectilinear tactile sidewalk tile to overlap the first connector flange, and positioning a second rectilinear tactile sidewalk tile to overlap the second connector flange. A plurality of truncated domes projects upwardly in a vertical direction from an upper surface of the first rectilinear tactile sidewalk tile and an upper surface of the second rectilinear tactile sidewalk tile.

An additional aspect of the present disclosure provides a connector tactile sidewalk tile including a wedge-shaped main body and a connector flange adjoining the wedge-shaped main body. A plurality of truncated domes may project upwardly in a vertical direction from an upper surface of the wedge-shaped main body. The connector flange may be stepped down from the wedge-shaped main body, such that an upper surface of the connector flange is offset downwardly in the vertical direction from the upper surface of the wedge-shaped main body.

DETAILED DESCRIPTION

The present disclosure generally relates to a connector tactile sidewalk tile for constructing an arcuate tactile sidewalk tile arrangement and a method of assembling an arcuate (e.g., curved) tactile sidewalk tile arrangement. The connector tactile sidewalk tile may be used in combination with one or more rectilinear (e.g., square, rectangular, triangular, semi-circular, pentagonal, or hexagonal) tactile sidewalk tiles to form an arcuate tactile sidewalk tile arrangement that follows the inside of a rounded sidewalk corner or other arcuate structure. Fasteners may be used to secure the one or more rectilinear tactile sidewalk tiles to the connector tactile sidewalk tile, thereby facilitating on-site assembly of the arcuate tactile sidewalk tile arrangement. The connector tactile sidewalk tile advantageously allows one or more rectilinear tactile sidewalk tiles to be arranged in an arcuate configuration without having to modify the shape of the one or more rectilinear tactile sidewalk tiles.

As used herein, the term "rectilinear" is defined to mean any shape having one or more straight sides. Examples of rectilinear shapes include, but are not limited to, a square, a rectangle, a triangle, a semi-circle, a pentagon, a hexagon, etc. The term "rectilinear," as used herein, encompasses a shape having a combination of one or more straight sides and one or more curved sides.

As used herein, the term "arcuate" is defined to mean any generally curved shape. The term "arcuate" encompasses a smooth, continuous curve, as well as, a curve defined by a combination of discrete straight segments.

Figure 1:
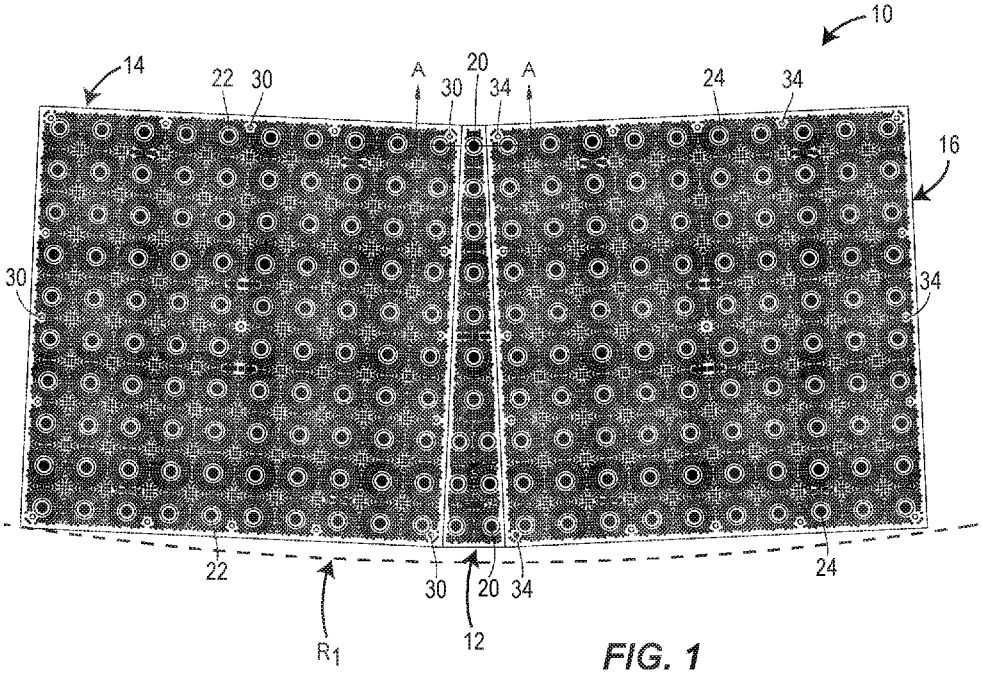
FIG. 1 is a top view of one embodiment of an arcuate tactile sidewalk tile arrangement constructed in accordance with principles of the present disclosure.
Figure 3:
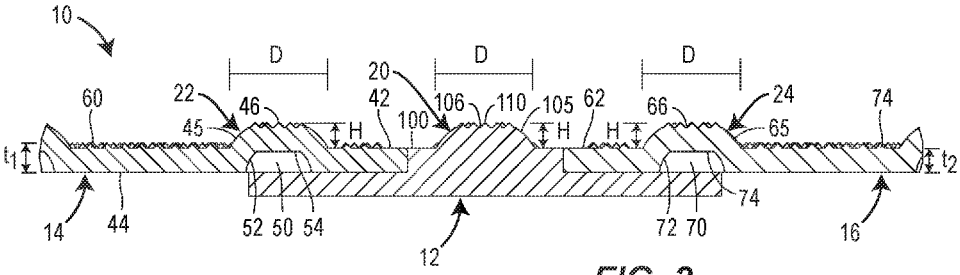
FIG. 3 is a cross-sectional view of FIG. 1 taken along line A-A.
Figure 4:
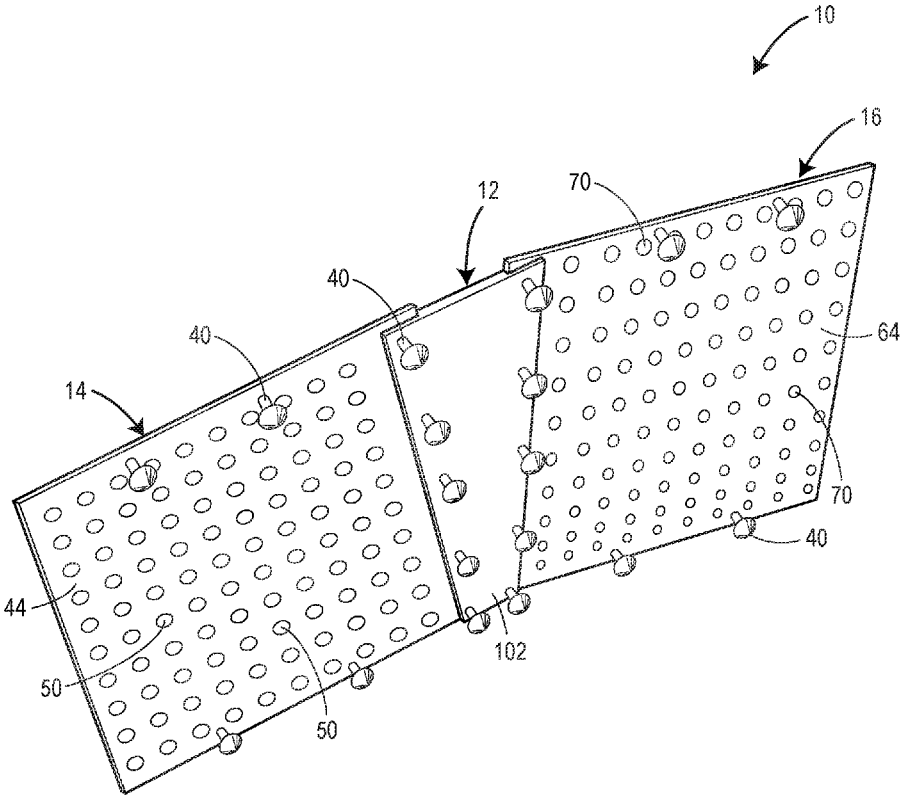
FIG. 4 is a bottom view of the arcuate tactile sidewalk tile arrangement of FIG. 1 having fasteners installed.

FIG. 1 illustrates a top view of one embodiment of an arcuate tactile sidewalk tile arrangement 10. The arcuate tactile sidewalk tile arrangement 10 may include a connector tactile sidewalk tile 12 arranged between a first rectilinear tactile sidewalk tile 14 and a second rectilinear tactile sidewalk tile 16. Each one of the tactile sidewalk tiles 12, 14, 16 may include, respectively, a plurality of truncated domes 20, 22, 24 that project upwardly in the vertical direction from an upper surface of the tile. Referring to FIG. 3, the connector tactile sidewalk tile 12 may include a main body 23 and first and second connector flanges 26, 28 that adjoin opposite sides of the main body 23. The first rectilinear tactile sidewalk 14 may overlap the first connector flange 26, and the second rectilinear tactile sidewalk 16 may overlap the second connector flange 28. The first rectilinear tactile sidewalk tile 14 may include a plurality of holes 30 which can be aligned with a plurality of holes 32 formed in the first connector flange 26. Similarly, the second rectilinear tactile sidewalk tile 16 may have a plurality of holes 34 which can be aligned with a plurality of holes 36 formed in the second connector flange 28. As illustrated in FIG. 4, fasteners 40 (not shown in FIGS. 1-3) may be inserted through aligned pairs of the holes 30, 32 to secure the first rectilinear tactile sidewalk tile 14 to the first connector flange 26. Likewise, the fasteners 40 may be inserted through aligned pairs of the holes 34, 36 to secure the second rectilinear tactile sidewalk tile 16 to the second connector flange 28. In addition to securing the tactile sidewalk tiles 12, 14, 16 to each other, the fasteners 40 may be configured to anchor the tactile sidewalk tiles 12, 14, 16 to a concrete underlayer, as discussed below.

Each of the foregoing components of the arcuate tactile sidewalk tile arrangement 10 and methods of assembling the arcuate tactile sidewalk tile arrangement 10 will now be described in more detail.

Referring to FIG. 1, the outer periphery of the first rectilinear tactile sidewalk tile 14 may have a rectangular, preferably square or generally square, shape. Other embodiments of the first rectilinear tactile sidewalk tile 14 may have an outer periphery that is shaped differently, including, for example, an outer periphery that is shaped as a non-square rectangle, a triangle, a semi-circle, a pentagon, a hexagon, or any other shape having at least one straight side. While the corners of the first rectilinear tactile sidewalk tile 14 illustrated in FIG. 1 are pointed, in other embodiments, one or more of the corners of the first rectilinear tactile sidewalk tile 14 may be rounded.

The first rectilinear tactile sidewalk tile 14 includes an upper surface 42 facing upwardly in the vertical direction and a lower surface 44 facing downwardly in the vertical direction. The truncated domes 22 project upwardly in the vertical direction from the upper surface 42 of the first rectilinear tactile sidewalk tile 14. Each truncated dome 22 may be defined by an annular or generally annular dome wall 45 that projects from the upper surface 42. The dome wall 45 may have a generally rounded or contoured shape, such as a convex shape, when viewed in cross-section. Alternatively, the cross-sectional shape may be linear and non-contoured. A planar or generally planar dome top surface 46 may define the top surface of each of the truncated domes 22, and the overall shape of the truncated dome 22 may thus resemble that of the exterior of an inverted bowl.

Each of the truncated domes 22 may have a maximum outer diameter D defined where the dome wall 45 meets the upper surface 42. In one embodiment, the maximum outer diameter D of each of the truncated domes 22 may be approximately (e.g., ±10%) 0.90 inches, or lesser or greater. In one embodiment, a height H of each of the truncated domes 22 may be approximately (e.g., ±10%) 0.20 inches, or lesser or greater. In one embodiment, a center-to-center spacing of the truncated domes 22 may be approximately (e.g., ±10%) 2.35 inches, or lesser or greater.

The truncated domes 22 may be arrayed across the upper surface 42 to form one or more patterns. In one embodiment, the pattern may be an array of parallel, equally-spaced linear rows and columns, as illustrated in FIG. 1. In other embodiments, the pattern may be a checkerboard pattern of aligned rows and staggered columns. In still further embodiments, the truncated domes 22 may be arranged in a non-linear pattern such as a circular pattern, a spiral pattern, a sinusoidal pattern, etc. Any suitable pattern may be selected for the truncated domes 22 based on the application and/or the type of tactile cue to be provided.

The thickness $t_1$ of the first rectilinear tactile sidewalk tile 14 may be defined as the distance between the upper and lower surfaces 42, 44. As discussed below in more detail, the thickness $t_1$ may be substantially equal to a distance by which an upper surface of the first connector flange 26 is offset downwardly from an upper surface of the main body 23. In one embodiment, the thickness $t_1$ may be approximately (e.g., ±10%) 0.14 inches, or lesser or greater.

Referring to FIG. 4, a plurality of dome depressions 50 may be arrayed across the lower surface 44, and each dome depression 50 may form the underside of a corresponding truncated dome 22 of the upper surface 42. Each dome depression 50 may be defined by an inner dome wall 52 that generally corresponds in shape to the dome wall 45 and a dome bottom surface 54 that generally corresponds in shape to the dome top surface 46. Because the general shape of the truncated dome 22 may resemble that of the exterior of an inverted bowl when viewed from the upper surface 42, the general shape of the dome depression 50 may thus resemble that of the interior of a bowl when viewed from the lower surface 44. A flush post (not illustrated) may be disposed inside some or all of the dome depressions 50. Examples of such flush posts are described in U.S. patent application Ser. No. 13/349,309, the entirety of which is hereby incorporated by reference. The flush post may become anchored in the concrete underlayer, thereby strengthening the bond between first rectilinear tactile sidewalk tile 14 and the concrete underlayer.

Figure 2:
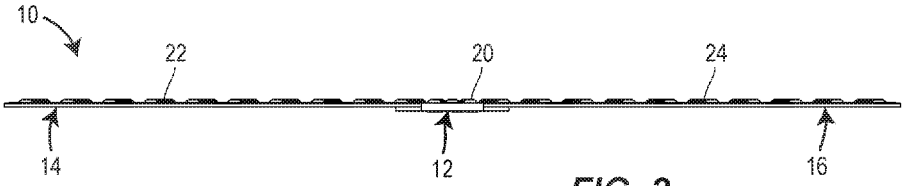
FIG. 2 is a front view of the tactile sidewalk tile arrangement of FIG. 1.

A plurality of conical pointed nubs 60 may project upwardly in the vertical direction from the upper surface 42 and the dome top surface 46, as illustrated in FIG. 2. The plurality of conical pointed nubs 60 may form a pattern on the upper surface 42, and the pattern may include a plurality of concentric circles expanding outwardly from each truncated dome 22. Alternatively, the first rectilinear tactile sidewalk tile 14 may not include any conical point nubs 60 such that the upper surface 42 and the dome top surface 46 are generally smooth.

As illustrated in FIG. 1, the holes 30 may be arranged around the periphery of the first rectilinear tactile sidewalk tile 14. Additionally, or as an alternative, the holes 30 may be arranged throughout the interior portion of the first rectilinear tactile sidewalk tile 14. The holes 30 are configured to receive the fasteners 40, as illustrated in FIG. 4. In one embodiment, the holes 30 are circular and have a diameter of approximately (e.g., ±10%) 0.26 inches, or lesser or greater.

The second rectilinear tactile sidewalk tile 16 may be configured in the same manner as the first rectilinear tactile sidewalk tile 14, so the foregoing description of the first rectilinear tactile sidewalk tile 14 applies to the second rectilinear tactile sidewalk tile 16 as well. Similar to the first rectilinear tactile sidewalk tile 14, the second rectilinear tactile sidewalk tile 16 may include an upper surface 62 facing upwardly in the vertical direction and a lower surface 64 facing downwardly in the vertical direction. Each truncated dome 24 may be defined by an annular or generally annular dome wall 65 that projects upwardly in the vertical direction from the upper surface 62. A planar or generally planar dome top surface 66 may define the top surface of each of the truncated domes 24, and the overall shape of the truncated dome 24 may thus resemble that of the exterior of an inverted bowl. A plurality of dome depressions 70 may be arrayed across the lower surface 64, and each dome depression 70 may be the underside of a corresponding truncated dome 24 formed on the upper surface 62. Each dome depression 70 may be defined by an inner dome wall 65 that generally corresponds in shape to the dome wall 75 and a dome bottom surface 74 that generally corresponds in shape to the dome top surface 66. The thickness $t_2$ of the second rectilinear tactile sidewalk tile 16 may be defined as the distance between the upper and lower surfaces 62, 64. The thickness $t_2$ may be substantially equal to a distance by which an upper surface of the second connector flange 28 is offset downwardly from an upper surface of the main body 23, as discussed below in more detail. A plurality of conical pointed nubs 79 may project upwardly in the vertical direction from the upper surface 62 and the dome top surface 66, as illustrated in FIG. 3. The holes 34 included in the second rectilinear tactile sidewalk tile 16 may be arranged and dimensioned in similar manner as the holes 30 of the first rectilinear tactile sidewalk tile 14.

Figure 5:
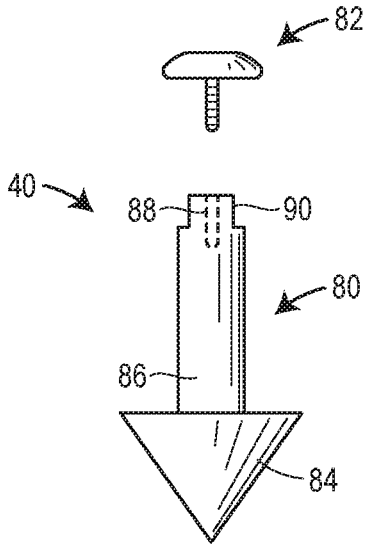
FIG. 5 is a side view of one of the fasteners illustrated in FIG. 4.

Referring to FIG. 5, each of the fasteners 40 may be formed by an anchor member 80 and a screw member 82. The anchor member 80 may include a conical base 84, and a stem 86 extending upwardly from the conical base 84. The upper end of the stem 86 may have formed by a reduced-diameter portion 88. When the fastener 40 is installed, the reduced-diameter portion 88 may extend through one or more of the holes 30, 32, 34, 36. A threaded blind bore 90 may extend downwardly into the reduced-diameter portion 88 of the stem 86. A threaded shaft 92 of the screw member 82 is configured to threadably engage the threaded blind bore 90, and thereby secure the anchor member 80, the screw member 82, and any tiles located therebetween.

Figure 6:
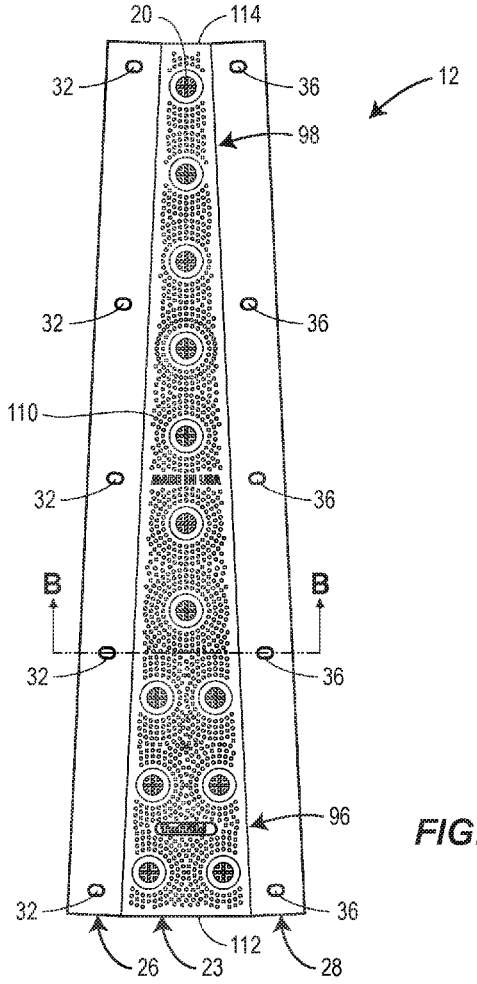
FIG. 6 is a top view of the connector tactile sidewalk tile used in the arcuate tactile sidewalk tile arrangement shown in FIG. 1.

The connector tactile sidewalk tile 12 will now be described with reference to FIGS. 6 and 7. The connector tactile sidewalk 12 may be formed by the main body 23 and the first and second connector flanges 26, 28 which adjoin opposite sides of the main body 23. In one embodiment, the main body 23 and the first and second connector flanges 26, 28 are integrally formed in one-piece as a single, unitary structure. In other embodiments, the main body 23 and the first and second connector flanges 26, 28 may be separate components that are joined together by fasteners, welds, adhesives, etc. As illustrated in FIG. 6, the first and second connector flanges 26, 28 may extend along the entire length of the main body 23. In other embodiments, the first and/or second connector flanges 26, 28 may border only a limited portion of the main body 23. In still further embodiments, the first and/or second connector flange 26, 28 may be formed by a plurality of discrete tabs which protrude from the longitudinal side(s) of the main body 23, with each of the tabs including one of the holes 32 or 36.

As depicted in FIG. 6, the main body 23 may be wedge-shaped such that an outer portion 96 of the main body 23 is wider than an inner portion 98 of the main body 23. While the wedge-shaped main body 23 illustrated in FIG. 6 is trapezoidal, other wedge-shaped configurations are possible, including, for example, a triangular shape (e.g., a right triangle, isosceles triangle, etc.), a pie shape, or any other shape having a tapered width.

The main body 23 includes an upper surface 100 facing upwardly in the vertical direction and a lower surface 102 facing downwardly in the vertical direction. The truncated domes 20 project upwardly in the vertical direction from the upper surface 100. Each truncated dome 20 may be defined by an annular or generally annular dome wall 105 that projects from the upper surface 100. The dome wall 105 may have a generally rounded or contoured shape, such as a convex shape, when viewed in cross-section. Alternatively, the cross-sectional shape may be linear and non-contoured. A planar or generally planar dome top surface 106 may define the top surface of each of the truncated domes 20, and the overall shape of the truncated dome 20 may thus resemble that of the exterior of an inverted bowl.

Each of the truncated domes 20 may have a maximum outer diameter D defined where the dome wall 105 meets the upper surface 100. In one embodiment, the maximum outer diameter D of each of the truncated domes 22 may be approximately (e.g., ±10%) 0.90 inches, or lesser or greater. In one embodiment, a height H of each of the truncated domes 20 may be approximately (e.g., ±10%) 0.20 inches, or lesser or greater. In one embodiment, a center-to-center spacing of the truncated domes 22 may be approximately (e.g., ±10%) 2.35 inches, or lesser or greater The truncated domes 20 may be arrayed across the upper surface 100 to form one or more patterns. As illustrated in FIG. 6, the pattern may be formed by aligning the truncated domes 20 along a plurality of imaginary concentric circles expanding outwardly from an imaginary center point, such that the truncated domes 20 arranged at different radii from the imaginary center point. Additionally, the truncated domes 20 illustrated in FIG. 6 are arranged in rows that extend along respective imaginary radial lines, with each of the imaginary radial lines extending from the imaginary center point. When the arcuate tactile sidewalk arrangement 10 is assembled, a center of curvature of the entire tactile sidewalk arrangement 10 may correspond to the imaginary center point of the imaginary concentric circles of truncated domes 20. Since the rows of truncated domes 20 illustrated in FIG. 6 extend along respective imaginary radial lines, the rows are non-parallel to each other. In other embodiments, the pattern may consist of an array of parallel, equally-spaced linear rows and columns. In still further embodiments, the pattern may be a checkerboard pattern of aligned rows and staggered columns. Other patterns are possible including spiral patterns, sinusoidal patterns, etc.

Since the outer portion 96 of the main body 23 is wider than the inner portion 98 of the main body 23, the outer portion 96 of the main body 23 may include a greater number of truncated domes 20 per unit length than the inner portion 98 of the main body 23. As the main body 23 increases in width, the number of truncated domes 20 per unit length may also increases. This arrangement may result in a generally equally-spaced distribution of truncated domes 20 across the main body 23. FIG. 6 illustrates that the outer portion 96 of the main body 23 includes two truncated domes 20 per a unit of length, whereas the inner portion 98 of the main body 23 includes a single truncated dome 20 for the same unit of length. As a result, the outer portion 96 of the main body 23 includes two radial rows of truncated domes 20, whereas the inner portion 98 of the main body 23 includes a single radial row of truncated domes 20. Other arrangements are envisioned, including an arrangement where the inner portion 98 of the main body 23 has a single radial row of truncated domes 20, a middle portion of the main body 23 has two radial rows of truncated domes 20, and the outer portion 96 of the main body 23 has three radial rows of truncated domes 20.

Figure 7:
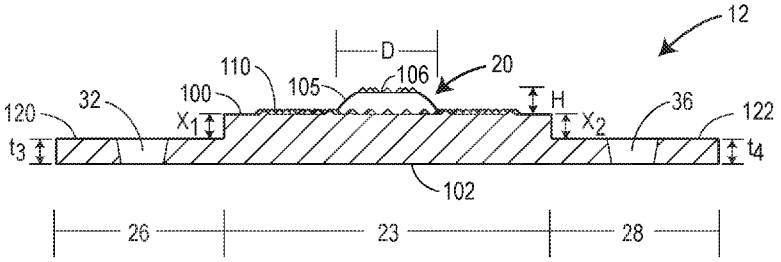
FIG. 7 is a cross-sectional view of the connector tactile sidewalk tile of FIG. 1 taken along line B-B.

As illustrated in FIG. 7, the lower surface 102 of the main body 23 may be planar or generally planar. Alternatively, a plurality of dome depressions (not illustrated) may be arrayed across the lower surface 102, with each dome depression corresponding to one of the truncated domes 20, in a similar manner to the arrangement of the truncated domes 22 and dome depressions 50 of the first rectilinear tactile sidewalk tile 14. Additionally, or alternatively, the lower surface 102 may include one or more grooves or protrusions to promote adhesion between the connector tactile sidewalk tile 12 and the concrete underlayer. In one embodiment, where the connector tactile sidewalk tile 20 is made of a polymer material, the lower surface 102 may include a plurality of molded-in crisscrossing linear protrusions, or ribs, configured to reinforce and/or stiffen the connector tactile sidewalk tile 20.

A plurality of conical pointed nubs 110 may project upwardly in the vertical direction from the upper surface 100 and the dome top surface 106, as illustrated in FIGS. 6 and 7. The plurality of conical pointed nubs 110 may form a pattern on the upper surface 100, and the pattern may include a plurality of concentric circles expanding outwardly from each truncated dome 20. Alternatively, the main body 23 may not include any conical point nubs such that the upper surface 100 and the dome top surface 106 are generally smooth.

The upper surface 100 includes an outer edge 112 and an inner edge 114. Since the outer portion 96 of the main body 23 is wider than the inner portion 98 of the main body 23, the outer edge 112 is wider than the inner edge 114. In the embodiment illustrated in FIG. 6, both the outer edge 112 and the inner edge 114 are linear. In other embodiments, the outer edge 112 and the inner edge 114 may be arcuate. In one embodiment, the outer edge 112 may have a radius of curvature which is greater than the radius of curvature of the inner edge 114. Alternatively, the outer edge 112 and the inner edge 114 may have the same radius of curvature.

As illustrated in FIG. 6, the connector flanges 26, 28 may each have a rectangular shape when viewed from above. In other embodiments, the connector flanges 26, 28 may each be wedge-shape such that an outer portion of each flange is wider than an inner portion of the flange. Each connector flange 26, 28 may be arranged orthogonally or generally orthogonally relative to a respective adjoining side of the main body 23.

Still referring to FIG. 6, the holes 32 may extend through the first connector flange 26, and the holes 36 may extend through the second connector flange 28. Each of the holes 32 may be aligned with a respective one of the holes 30 of the first rectilinear tactile sidewalk tile 14, and each of the holes 36 may align with a respective one of the holes 34 of the second rectilinear tactile sidewalk tile 16. Once aligned, the fasteners 40 may be inserted through aligned pairs of the holes 30, 32 and aligned pairs of the holes 34, 36. The holes 32 may have a different shape and/or dimension than the holes 30, and the holes 34 may have a different shape and/or dimension than the holes 36. For example, the holes 32, 36 illustrated in FIG. 6 are oval-shaped, whereas the holes 30, 36 are circular. The dissimilar dimensions and/or shapes of the aligned pairs of the holes 30, 32 and the aligned pairs of the holes 34, 36 may allow the first and second rectilinear tactile sidewalk tiles 14, 16 to move relative to the connector tactile sidewalk tile 12. This feature may facilitate fine adjustments of the first and second rectilinear tactile sidewalk tile 14, 16 after the fasteners 40 are inserted and prior to their final tightening.

Referring to FIG. 7, the connector flange 26 is stepped down from the main body 23 such that an upper surface 120 of the connector flange 26 is offset downwardly in the vertical direction from the upper surface 100 of the main body 23 by an offset distance $X_1$. Similarly, the connector flange 28 is stepped down from the main body 23 such that an upper surface 122 of the connector flange 26 is offset downwardly in the vertical direction from the upper surface 100 of the main body 23 by an offset distance $X_2$. As a result, a step-shaped shoulder is formed between the connector flange 26 and the main body 23, as well as between the connector flange 28 and the main body 23. While FIG. 7 illustrates a 90° angle formed by the step-shaped shoulder between the connector flange 26 and the main body 23, as well as the step-shaped shoulder between connector flange 26 and the main body 23, the connector flanges 26, 28 may still be considered "stepped down" from main body 23 even if their respective step-shaped shoulders do not form a 90° angle, and even if step-shaped shoulder follows a curve. The offset distance $X_1$ may be equal or substantially equal to thickness $t_1$ of the first rectilinear tactile sidewalk tile 14. Therefore, when assembled, the upper surface 42 of the first rectilinear tactile sidewalk tile 14 may be level or substantially level with the upper surface 100 of the main body 23. Similarly, the offset distance $X_2$ may be equal or substantially equal to the thickness $t_2$ of the second rectilinear tactile sidewalk tile 16. Therefore, when assembled, the upper surface 62 of the second rectilinear tactile sidewalk tile 16 is level or generally level with the upper surface 100 of the main body 23.

As shown in FIGS. 6 and 7, the upper surfaces 120, 122 of the first and second connector flanges 26, 28 may be planar or substantially planar so that they can be pressed in flush engagement with the bottom surfaces 44, 64 of the first and second rectilinear tactile sidewalk tiles 14, 16. The upper surfaces 120, 122 and/or the bottom surfaces 44, 64 may have a surface roughness to increase friction between the first and second connector flanges 26, 28 and the first and second rectilinear tactile sidewalk tiles 14, 16.

In one embodiment, the overall length of the main body 23 is approximately (e.g., ±10%) 24 inches, or lesser or greater, the width of the outer edge 112 is approximately (e.g., ±10%) 3.5 inches, or lesser or greater, and the width of the inner edge 114 is approximately (e.g., ±10%) 1.35 inches, or lesser or greater.

The tactile sidewalk tiles 12, 14, 16 may be made of any suitably durable material including polymer, plastic, metal, ceramic, etc. One or more of the tactile sidewalk tiles 12, 14, 16 may be made of an injection molded plastic, such as Nylon, PVC, polypropylene, PC/PBT, copolymer polyester, PC/ABS, etc. Furthermore, one or more of the tactile sidewalk tiles 12, 14, 16 may be made from a metal alloy such as stainless steel or cast iron. In one embodiment, the connector sidewalk tile 12 is made of cast iron, and each of the first and second rectilinear tactile sidewalk tiles 14, 16 is also made of cast iron. In another embodiment, the connector sidewalk tile 12, the first rectilinear tactile sidewalk tile 14, and the second rectilinear tactile sidewalk tile 16 are each made of an injection molded plastic.

Referring back to FIG. 1, although the edges of the connector tactile sidewalk tile 12 and the edges of the first and second rectilinear sidewalk tiles 14, 16 may be linear, the overall arrangement of the connector tactile sidewalk tile 12 and the first and second rectilinear sidewalk tiles 14, 16 may have an effective radius of curvature $R_1$. As shown in FIG. 1, the effective radius of curvature $R_1$ may be measured by an imaginary curve that follows, or generally follows, the outer edge of the arcuate tactile sidewalk tile arrangement 10. The effective radius of curvature $R_1$ may depend on the length and width of the connector tactile sidewalk tile 12, as well as the lengths and widths of the first and second rectilinear tactile sidewalk tiles 14, 16. The effective radius of curvature $R_1$ may be in a range between approximately (e.g., ±10%) 8.0 and 45.0 feet. In some embodiments, the effective radius of curvature may be equal to approximately (e.g., ±10%) 8.8 feet, 11.5 feet, 14.1 feet, 16.8 feet, 18.0 feet, 20.0 feet, 25.0 feet, 28.5 feet, 30.0 feet, 36.6 feet, or 43.3 feet.

Figure 8:
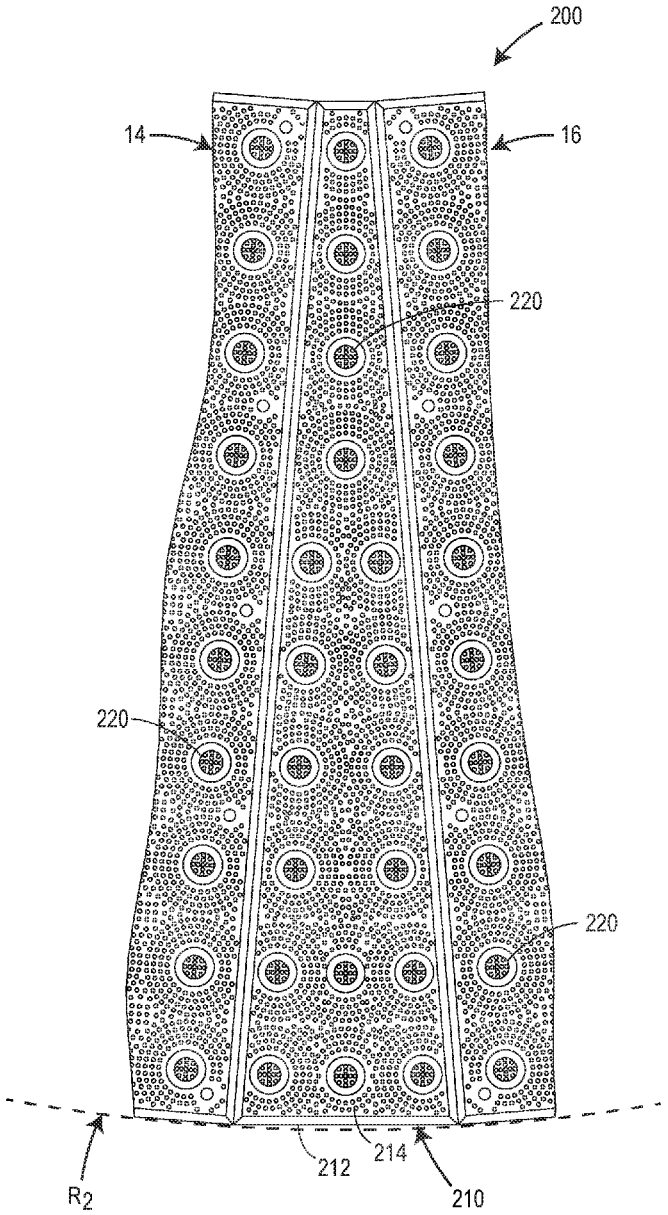
FIG. 8 is a top view of another embodiment of an arcuate tactile sidewalk tile arrangement constructed in accordance with principles of the present disclosure.

FIG. 8 illustrates another embodiment of an arcuate tactile sidewalk tile arrangement 200. The arcuate tactile sidewalk tile arrangement 200 includes the same structural and functional features as the arcuate tactile sidewalk tile arrangement 10, except that the shape of a connector tactile sidewalk tile 210 used by the arcuate tactile sidewalk tile arrangement 200 differs from the shape of the connector tactile sidewalk tile 12. More particularly, an outer edge 212 of a main body 214 of the connector tactile sidewalk tile 210 is wider than the outer edge 112 of the main body 23 of the connector sidewalk tile 12. As a result, an outer portion of the connector sidewalk tile 210 has a greater number of truncated domes 220 per unit of length than the outer portion of the connector sidewalk tile 12. Also, as a result of the wider outer edge 212 of the main body 214, the connector tactile sidewalk tile 210 imparts the arcuate tactile sidewalk tile arrangement 200 with an effective radius of curvature $R_2$ that is smaller than the effective radius of curvature $R_1$ of the arcuate tactile sidewalk tile arrangement 10, assuming that all other dimensions of the connector tactile sidewalk tile 210 and the connector tactile sidewalk tile 12 are the same. Thus, the arcuate tactile sidewalk tile arrangement 200 may be suitable for sharp or abrupt sidewalk corners, whereas the arcuate tactile sidewalk tile arrangement 10 may be more suitable for gently curving sidewalk corners. It is noted that the flanges of the connector sidewalk tile 200 are hidden from view in FIG. 8 by the first and second rectilinear tactile sidewalk tile 14, 16.

This particular distribution or arrangement of truncated domes on the exposed surface of an of the embodiments of a connector sidewalk tile of the present disclosure is an aesthetic feature not dictated by function.

A method of assembling the arcuate tactile sidewalk tile arrangement 10 will now be described. The steps described below can also be used to assemble the tactile sidewalk tile arrangement 200. As a preliminary step, a construction worker or other individual may measure the curvature and/or length of the arcuate structure to be bordered by the arcuate tactile sidewalk tile arrangement 10. Based on these measurements, the individual may select an appropriate number of connector tactile sidewalk tiles 12 and conventional rectilinear (e.g., rectangular) tactile tiles 14, 16 for constructing the arcuate tactile sidewalk tile arrangement 10.

Next, the first rectilinear tactile sidewalk tile 14 may be arranged to overlap the first connector flange 26, with each of the holes 30 aligned with a corresponding one of the holes 32. Then, anchor members 80 may be inserted through aligned pairs of the holes 30, 32. Before threading the screw members 82 into the anchor members 80, the first rectilinear tactile sidewalk tile 14 may be moved slightly relative to first connector flange 26 by taking advantage of the difference in shape and/or size of between the holes 30, 32. These fine adjustments may help ensure that the arcuate tactile sidewalk tile arrangement 10 has a proper curvature when assembled. Subsequently, the screw members 82 may be inserted into their corresponding anchor members 80 to rigidly secure the first rectilinear tactile sidewalk tile 14 and the first connector flange 26.

The same process may be repeated for the second rectilinear tactile sidewalk tile 16. The second rectilinear tactile sidewalk tile 16 may be arranged to overlap the second connector flange 28, with each of the holes 36 aligned with a corresponding one of the holes 34. Then, anchor members 80 may be inserted through aligned pairs of the holes 34, 36. Before threading the screw members 82 into the anchor members 80, the second rectilinear tactile sidewalk tile 16 may be moved slightly relative to second connector flange 28 by taking advantage of the difference in shape and/or size between the holes 34, 36. Subsequently, the screw members 82 may be inserted into their corresponding anchor members 80 to rigidly secure the second rectilinear tactile sidewalk tile 16 and the second connector flange 28.

Depending on the size and/or curvature of the arcuate structure to be bordered by the arcuate tactile sidewalk tile arrangement 10, one or more additional connector tactile sidewalk tiles may be attached to facilitate the connection of one or more additional rectilinear tactile sidewalk tiles. Finally, the arcuate tactile sidewalk tile arrangement 10 may be placed over wet concrete, with the anchor members 84 submerged in the concrete. It is recognized that the installer may choose not to pre-assemble an entire array of a plurality of rectilinear tactile sidewalk tiles 14, 16 and a plurality of intermediately-arranged connector tactile sidewalk tiles 12, but rather, can pre-assemble sub-arrays of two rectilinear tactile sidewalk tiles 14, 16 that alternate with two connector tactile sidewalk tiles 12 (in a square tile—wedge—square tile—wedge arrangement), install that sub-array into the wet concrete or asphalt, then add additional sub-arrays of one or more tiles until the arcuate tile arrangement 10 is completed.

If the arcuate tactile sidewalk tile arrangement is pre-assembled before its installation in wet concrete, one or more construction workers may manually carry the arcuate tactile sidewalk tile arrangement from its assembly site and then delicately set the arcuate tactile sidewalk tile arrangement in its desired position in the wet concrete. The heavier the arcuate tactile sidewalk tile arrangement the more cumbersome it can be for the construction workers to handle the arcuate tactile sidewalk tile arrangement and maneuver it into its desired position. If a dense material such as cast iron or other metal alloy is used to construct the connector tactile sidewalk tile and/or the rectilinear sidewalk tiles used therewith, as opposed to a lighter material such as plastic, the arcuate tactile sidewalk tile arrangement may be relatively heavy, thereby making it difficult for construction workers to handle and install arcuate tactile sidewalk tile arrangement.

Figure 9:
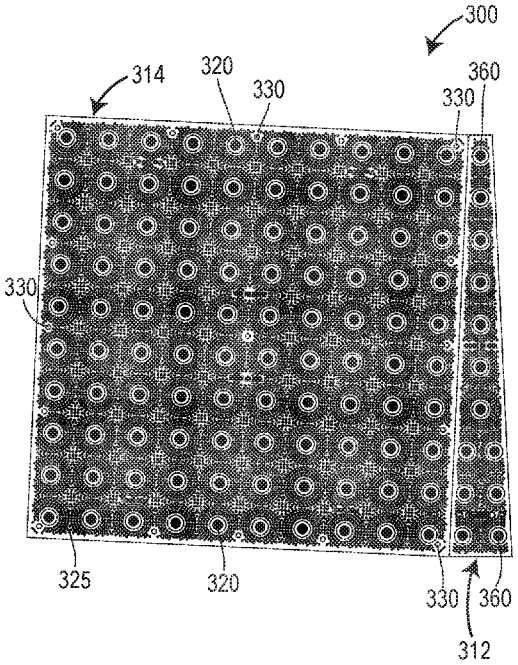
FIG. 9 is a top view of yet another embodiment of an arcuate tactile sidewalk tile arrangement constructed in accordance with principles of the present disclosure.

FIG. 9 illustrates an arcuate tactile sidewalk tile arrangement 300 that utilizes a connector tactile sidewalk tile 312 having a single flange for connecting to a single rectilinear tactile sidewalk tile 314. The rectilinear tactile sidewalk tile 314 may include the same structural and functional features as the first rectilinear tactile sidewalk tile 14 described above; and the connector tactile sidewalk tile 312 may include the same structural and functional features as the connector tactile sidewalk tile 12 described above, except that the connector tactile sidewalk tile 312 has only one flange 326 (seen in FIG. 10). The reduced sized and weight of the arcuate tactile sidewalk tile arrangement 300, as compared to the arcuate tactile sidewalk tile arrangement 10, facilitates the use of cast iron or another metal alloy for the connector tactile sidewalk tile 312. Although such materials may substantially increase the weight of the arcuate tactile sidewalk tile arrangement 300, construction workers may still be able to nimbly handle and/or maneuver the arcuate tactile sidewalk tile arrangement 300 because it does not include more than one rectilinear tactile sidewalk tile.

Similar to the first rectilinear tactile sidewalk tile 14, the rectilinear tactile sidewalk tile 314 may include a plurality of truncated domes 320 and a plurality of conical pointed nubs 322 that project upwardly in the vertical direction from an upper surface 325 of the rectilinear tactile sidewalk tile 314. The rectilinear tactile sidewalk tile 314 may include a plurality of holes 330 which can be aligned with a plurality of holes 332 formed in the connector flange 326 of the connector tactile sidewalk tile 312 when the rectilinear tactile sidewalk tile 314 is arranged to overlap the connector flange 326. Fasteners (not illustrated in FIG. 9) similar to the fasteners 40 may be inserted through aligned pairs of the holes 330, 332 to secure the rectilinear tactile sidewalk tile 314 to the connector flange 326, as well as, anchor the rectilinear tactile sidewalk tile 314 and the connector tactile sidewalk tile 312 to a concrete underlayer.

Figure 10:
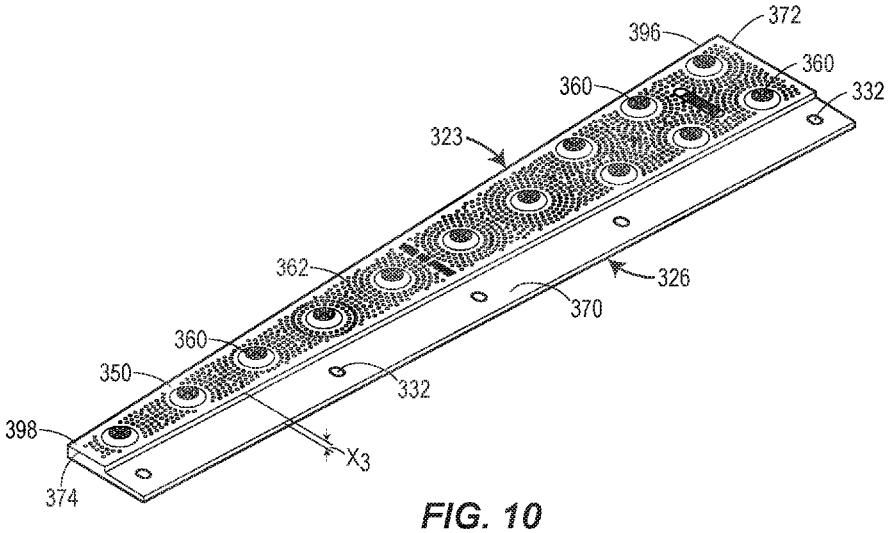
FIG. 10 is a perspective view of the connector tactile sidewalk tile used in the arcuate tactile sidewalk tile arrangement shown in FIG. 1.

Referring to FIG. 10, the connector tactile sidewalk tile 312 may be formed by a main body 323 and the connector flange 326 which adjoins a longitudinal side of the main body 323. In one embodiment, the main body 323 and the connector flange 326 may be integrally formed in one-piece as a single, unitary structure. In other embodiments, the main body 323 and the connector flange 326 may separate components that are joined together by fasteners, welds, adhesives, etc. The connector flange 326 may extend along the entire length of the main body 323. In other embodiments, the connector flange 326 may border only a limited portion of the main body 323. In still further embodiments, the connector flange 326 may be formed by a plurality of discrete tabs which protrude from the longitudinal side(s) of the main body 323, with each of the tabs including one of the holes 323.

As depicted in FIG. 10, the main body 323 may be wedge-shaped such that an outer portion 396 of the main body 323 is wider than an inner portion 398 of the main body 323. While the wedge-shaped main body 323 illustrated in FIG. 10 is trapezoidal, other wedge-shaped configurations are possible, including, for example, a triangular shape (e.g., a right triangle, isosceles triangle, etc.), a pie shape, or any other shape having a tapered width.

The main body 323 includes an upper surface 350 facing upwardly in the vertical direction and a lower surface facing downwardly in the vertical direction. Similar to the connector sidewalk tile 312, a plurality of truncated domes 360 and a plurality of conical pointed nubs 362 project upwardly in the vertical direction from the upper surface 350 of the main body 323.

The upper surface 350 includes an outer edge 372 and an inner edge 374. Since the outer portion 396 of the main body 323 is wider than the inner portion 398 of the main body 323, the outer edge 372 is wider than the inner edge 374. In the embodiment illustrated in FIG. 10, both the outer edge 372 and the inner edge 374 are linear. In other embodiments, the outer edge 374 and the inner edge 374 may be arcuate. In one embodiment, the outer edge 372 may have a radius of curvature which is greater than the radius of curvature of the inner edge 374. Alternatively, the outer edge 372 and the inner edge 374 may have the same radius of curvature.

In one embodiment, the overall length of the main body 323 is approximately (e.g., ±10%) 24 inches, or lesser or greater, the width of the outer edge 372 is approximately (e.g., ±10%) 3.5 inches, or lesser or greater, and the width of the inner edge 374 is approximately (e.g., ±10%) 1.35 inches, or lesser or greater.

The holes 332 may extend through the connector flange 326 and may have a different shape and/or dimension than the holes 330. For example, the holes 332 illustrated in FIG. 10 are oval-shaped, whereas the holes 330 are circular. The dissimilar dimensions and/or shapes of the aligned pairs of the holes 330, 332 allows the rectilinear tactile sidewalk tile 314 to move relative to the connector tactile sidewalk tile 312. This feature may facilitate fine adjustments the rectilinear tactile sidewalk tile 314 after the fasteners have been inserted and prior to their final tightening.

Still referring to FIG. 10, the connector flange 326 possesses an upper surface 370 that is offset downwardly in the vertical direction from the upper surface 350 of the main body 323 by an offset distance $X_3$. As a result, a step-shaped shoulder is formed between the connector flange 326 and the main body 323. The offset distance $X_3$ may be equal or substantially equal to a thickness of the rectilinear tactile sidewalk tile 314. Therefore, when assembled, the upper surface 325 of the rectilinear tactile sidewalk tile 314 may be level or substantially level with the upper surface 350 of the main body 323.

As shown in FIG. 10, the upper surface 370 of the connector flange 326 may be planar or substantially planar so that it can be pressed in flush engagement with a planar bottom surface of the rectilinear tactile sidewalk tiles 326. The upper surfaces 370 of the connector flange 326 and/or the bottom surface of the rectilinear tactile sidewalk tiles 326 may have a surface roughness to increase friction between the connector flange 326 and the rectilinear tactile sidewalk tile 314.

The tactile sidewalk tile 314 may be made of any suitably durable material including polymer, plastic, metal, stainless steel, cast iron, ceramic, etc. In one embodiment the tactile sidewalk tile 314 may be made of an injection molded plastic, such as Nylon, PVC, polypropylene, PC/PBT, copolymer polyester, PC/ABS, etc. The connector sidewalk tile 312 may be made from a metal alloy such as stainless steel or cast iron. In one embodiment, the connector sidewalk tile 12 is made of cast iron, and the rectilinear tactile sidewalk tile 314 is made of cast iron. In another embodiment, the connector sidewalk tile 312 and the rectilinear tactile sidewalk tile 314 are each made of an injection molded plastic.

Some applications may require an arcuate tactile sidewalk tile arrangement having a radius of curvature that is difficult or impossible to achieve by positioning a single connector tactile sidewalk tile between each pair of rectilinear tactile sidewalk tiles. Also, some applications may require an overall length of the arcuate tactile sidewalk tile arrangement that cannot be achieved with the standard sizes commonly employed by the rectilinear tactile sidewalk tiles. Furthermore, in some instances, the construction crew responsible for installing the arcuate tactile sidewalk tile arrangement may not have, at their convenient disposal, a connector tactile sidewalk tile having the dimensions necessary to create a desired radius of curvature. In these situations, and others, it may be useful to arrange two or more connector tactile sidewalk tiles between each pair of rectilinear tactile sidewalk tiles, as illustrated in FIG. 11.

Figure 11:
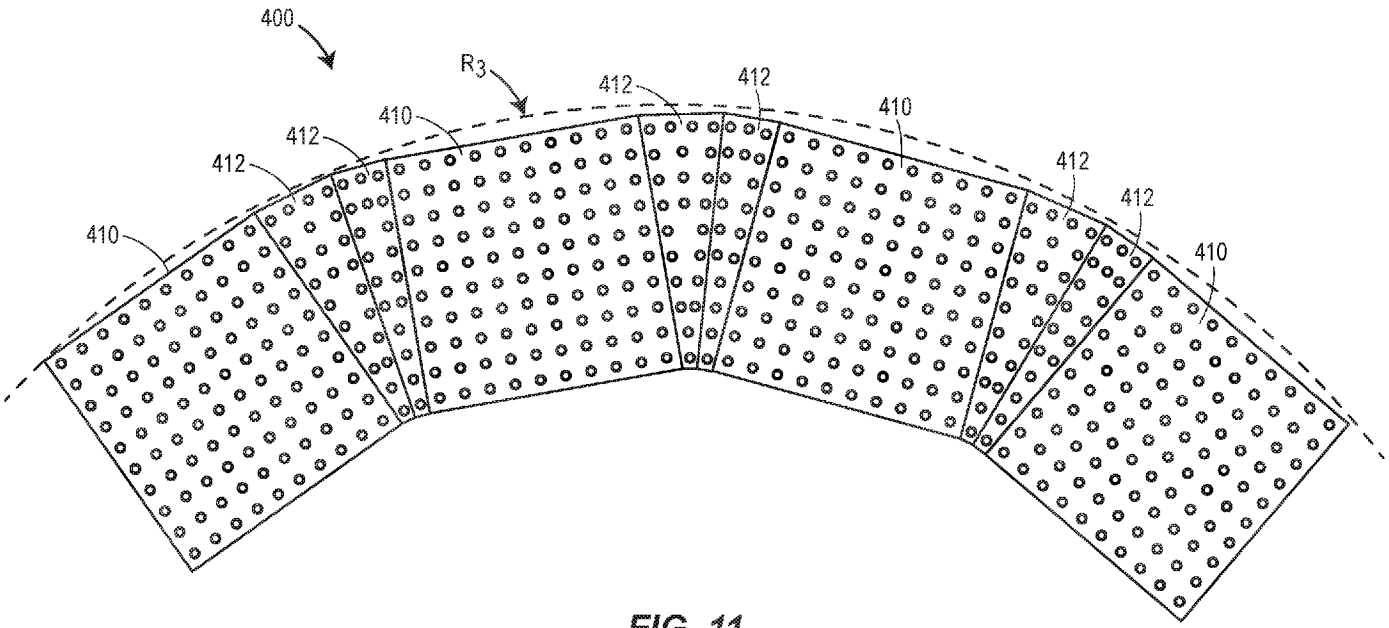
FIG. 11 is a top view of another embodiment of an arcuate tactile sidewalk tile arrangement constructed in accordance with principles of the present disclosure.

FIG. 11 depicts an arcuate tactile sidewalk tile arrangement 400 including a plurality of rectilinear tactile sidewalk tiles 410, with each one of the rectilinear tactile sidewalk tiles 410 being separated from an adjacent one of the rectilinear tactile sidewalk tiles 410 by at least two connector tactile sidewalk tiles 412. The connector tactile sidewalk tiles 412 may be similar to the connector tactile sidewalk tiles discussed above with respect to FIGS. 1-9, except that each of the connector tactile sidewalk tiles 412 may have only a single connector flange, which is secured to the adjacent rectilinear tactile sidewalk tile 410. The flangeless side of the connector tactile sidewalk tile 412 may abut the flangeless side of the adjacent connector tactile sidewalk tile 412. The connector tactile sidewalk tile 412 may be similar to the single-flange cast iron connector tactile sidewalk tile 312 illustrated in FIG. 10. Alternatively, the connector tactile sidewalk tile 412 may be a polymer-based connector tactile sidewalk tile having one of its flanges cut off, for example, by a construction worker at the installation site.

As shown in FIG. 11, each abutting pair of connector tactile sidewalk tiles 412 may include connector tactile sidewalk tactile 412 whose dimensions are different from each other. Accordingly, an effective radius of curvature R3 may be different from that which is achievable by using one or more of the same type of connector sidewalk tile between each pair of the rectilinear tactile sidewalk tiles. In alternative embodiments, two or more of the same type of connector sidewalk tile may be positioned between each pair of rectilinear tactile sidewalk tiles.

While the embodiment illustrated in FIG. 11 envisions each of the connector tactile sidewalk tiles 412 having a single flange, in alternative embodiments, a double-flange connector tactile sidewalk tile 412 and a single-flange connector tactile sidewalk tile 412 may be positioned between each pair of rectilinear tactile sidewalk tiles 412. In such embodiments, the single-flange connector tactile sidewalk tile 412 may have a hole drilled through its main body so that it can be aligned with a hole in one of the flanges of the double-flange connector tactile sidewalk tile 412. Accordingly, the main body of the single-flange connector tactile sidewalk tile 412 can be positioned to overlap one of the flanges of the double-flange connector tactile sidewalk tile 412, and a fastener can be inserted through the hole in the single-flange connector tactile sidewalk tile 412 and the hole in the flange of the double-flange connector tactile sidewalk tile 412 to secure the single-flange connector tactile sidewalk tile 412 to the double-flange connector tactile sidewalk tile 412.

The foregoing embodiments generally describe installing the arcuate tactile sidewalk arrangement in wet concrete or another settable material. However, the present disclosure is not limited to such implementations. It is possible to install an arcuate tactile sidewalk arrangement constructed in accordance with principles of the present disclosure in any surface, including a rigid surface that has already hardened from a settable material. In such implementations, the arcuate tactile sidewalk arrangement may be considered "surface-mounted," and in some cases, the arcuate tactile sidewalk arrangement may protrude substantially above the mounting surface. To reduce the likelihood that snow plow strikes to the edges of the arcuate tactile sidewalk arrangement will cause damage to any tiles of the tactile sidewalk arrangement, the upper surface of each of the rectilinear and connector tactile sidewalk tiles may be constructed with a chamfered outer peripheral edge, as discussed in more detail below.

Figure 12:
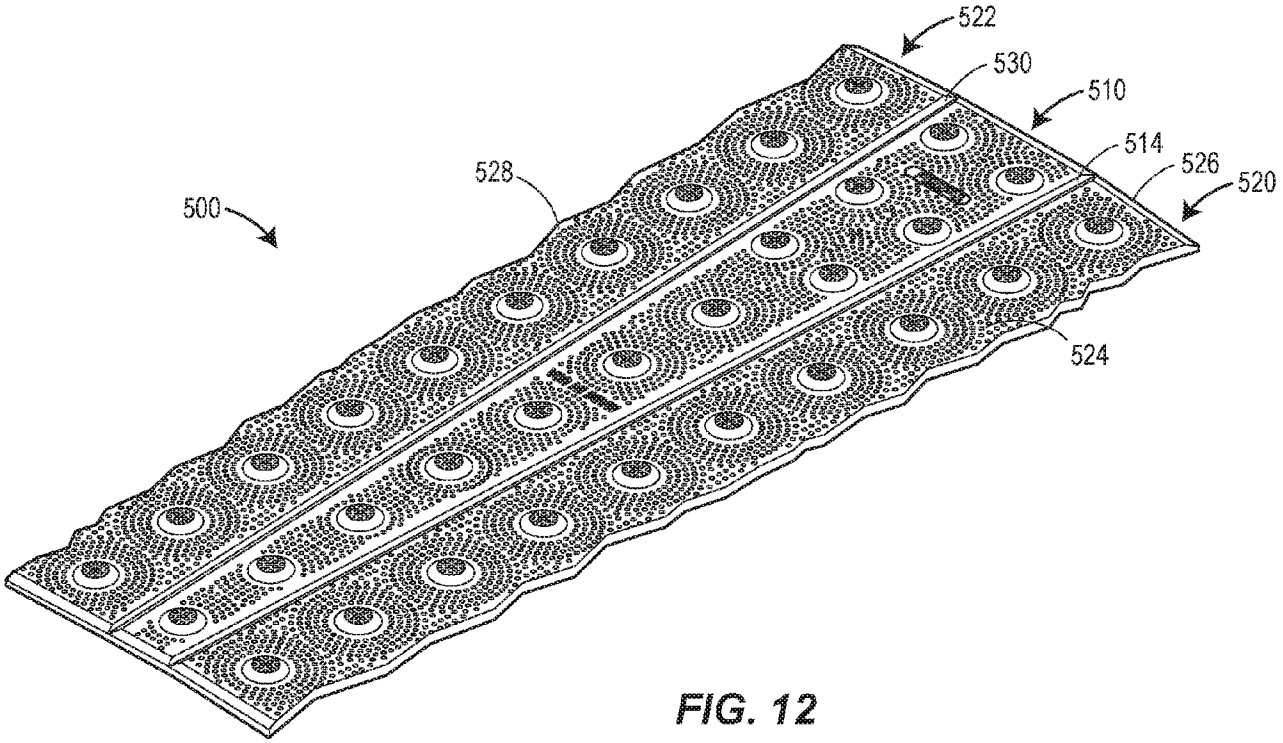
FIG. 12 is a perspective view of another embodiment of an arcuate tactile sidewalk tile arrangement constructed in accordance with principles of the present disclosure.

FIG. 12 illustrates an arcuate tactile sidewalk arrangement 500 having features similar to the arcuate tactile sidewalk arrangement 100 illustrated in FIG. 1, except that each of its tactile sidewalk tiles includes an upper surface with a chamfered outer peripheral edge. More particularly, the arcuate tactile sidewalk arrangement 500 includes a connector tactile sidewalk tile 510 including an upper surface 512 having a chamfered outer peripheral edge 514. In addition, the arcuate tactile sidewalk arrangement 500 includes a first rectilinear tactile sidewalk tile 520 and a second rectilinear tactile sidewalk tile 522 which overlap flanges (not shown) that extend from opposite sides of the connector tactile sidewalk tile 510. The first rectilinear tactile sidewalk tile 520 includes an upper surface 524 having chamfered outer peripheral edge 526, and the second rectilinear tactile sidewalk tile 522 includes an upper surface 528 having a chamfered outer peripheral edge 530. Only a portion of each of the first and second rectilinear tactile sidewalk tiles 520, 522 is illustrated in FIG. 12, so the entire outer peripheral edge of each of the first and second rectilinear tactile sidewalk tiles 520 and 522 is not depicted. However, in reality preferred embodiment, the chamfered outer peripheral edge 526 extends around the entire periphery of the rectilinear tactile sidewalk tile 520, and the chamfered outer peripheral edge 530 extends around the entire periphery of the second rectilinear tactile sidewalk tile 522. In some embodiments, each of the chamfered outer peripheral edges 514, 526, and 530 may form an angle in a range between approximately (e.g., ±10%) 5-45 degrees, or 10-35 degrees, or 15-25 degrees, with an imaginary horizontal plane that may be parallel to the mounting surface. Furthermore, each of the tactile sidewalk tiles 510, 520, and 522 may be made of a polymer-based material (e.g., injection molded plastic). Like the chamfered edges of the rectilinear sidewalk tile 520, the chamfered edges of the connector tactile sidewalk tile 510 serve as a ramp to dampen impact with the tile arrangement upon contact by, for example, a cutting edge of a snowplow blade.

The connector tactile sidewalk tiles of the present disclosure facilitate the assembly of an arcuate tactile sidewalk tile arrangement from one or more rectilinear tactile sidewalk tiles. Since the arcuate tactile sidewalk tile arrangement can be assembled without modification to the shape of the rectilinear tactile sidewalk tiles, special tools for cutting the rectilinear tactile sidewalk tiles may not be required. Additionally, the relative simplicity of the assembly facilitates on-site construction of the arcuate tactile sidewalk tile arrangement, which is particularly beneficial in situations where the exact curvature of the structure to be bordered by the arcuate tactile sidewalk tile arrangement is unknown beforehand. Accordingly, the present disclosure provides a low cost and efficient means for creating an arcuate tactile sidewalk tile arrangement.

While the present disclosure has been described with respect to certain embodiments, it will be understood that variations may be made thereto that are still within the scope of the appended claims.

What is claimed is:

1. A tactile sidewalk tile arrangement comprising:

a connector tactile sidewalk tile including a wedge-shaped main body and a connector flange adjoining of the wedge-shaped main body;

a rectilinear tactile sidewalk tile, at least a portion of the rectilinear tactile sidewalk tile being positioned above the connector flange in a vertical direction; and a plurality of truncated domes projecting upwardly in the vertical direction from an upper surface of the wedge-shaped main body and an upper surface of the rectilinear tactile sidewalk tile.

2. The tactile sidewalk tile arrangement of claim 1, further comprising:

the connector flange being stepped down from the wedge-shaped main body such that an upper surface of the connector flange is offset downwardly in the vertical direction from the upper surface of the wedge-shaped main body by an offset distance.

3. The tactile sidewalk tile arrangement of claim 2, further comprising:

the rectilinear tactile sidewalk tile having a thickness equal to the offset distance such that the upper surface of the rectilinear tactile sidewalk tile is substantially level with the upper surface of the wedge-shaped main body of the connector tactile sidewalk tile.

4. The tactile sidewalk tile arrangement of claim 1, the wedge-shaped main body having first and second longitudinal sides, the connector flange adjoining the first longitudinal side of the wedge-shaped main body, the second longitudinal side of the wedge-shaped main body being free of an adjoining connector flange.

5. The arcuate tactile sidewalk tile arrangement of claim 1, the connector flange including a plurality of tabs protruding from the wedge-shaped main body, a hole being formed in each tab of the plurality of tabs.

6. The tactile sidewalk tile arrangement of claim 1, further comprising:

a fastener passing through a hole in the connector flange and a hole in the rectilinear tactile sidewalk tile to secure the rectilinear tactile sidewalk tile to the connector flange.

7. The tactile sidewalk tile arrangement of claim 1, further comprising:

the rectilinear tactile sidewalk tile including a lower surface having a plurality of dome depressions, each of the dome depressions corresponding to one of the truncated domes of the upper surface of the rectilinear tactile sidewalk tile.

8. A method of assembling a tactile sidewalk tile arrangement, the method comprising:

providing a connector tactile sidewalk tile including a wedge-shaped main body, a connector flange adjoining the wedge-shaped main body, and a plurality of truncated domes projecting upwardly in a vertical direction from an upper surface of the wedge-shaped main body; and positioning at least a portion of a rectilinear tactile sidewalk tile above the connector flange in a vertical direction, the rectilinear tactile sidewalk tile including a plurality of truncated domes projecting upwardly in the vertical direction from an upper surface of the first rectilinear tactile sidewalk tile.

9. The method of claim 8, further comprising:

securing the rectilinear tactile sidewalk tile to the connector flange by inserting a fastener through a hole in the rectilinear tactile sidewalk tile and a hole in the connector flange.

10. The method of claim 8, further comprising:

the connector flange being stepped down from the wedge-shaped main body such that an upper surface of the connector flange is offset downwardly in the vertical direction from the upper surface of the wedge-shaped main body an offset distance.

11. The method of claim 10, further comprising:

the rectilinear tactile sidewalk tile having a thickness equal to the offset distance such that the upper surface of the rectilinear tactile sidewalk tile is substantially level with the upper surface of the wedge-shaped main body of the connector tactile sidewalk tile.

12. The method of claim 8, further comprising:

the rectilinear tactile sidewalk tile including a lower surface having a plurality of dome depressions, each of the dome depressions corresponding to one of the truncated domes of the upper surface of the rectilinear tactile sidewalk tile.

13. A connector tactile sidewalk tile comprising:

a wedge-shaped main body;

a plurality of truncated domes projecting upwardly in a vertical direction from an upper surface of the wedge-shaped main body; and a connector flange adjoining the wedge-shaped main body, an upper surface of the connector flange being free of any truncated domes.

14. The connector tactile sidewalk tile of claim 13, further comprising a plurality of fastener-receiving holes passing through the connector flange.

15. The connector tactile sidewalk tile of claim 13, the connector flange including a plurality of tabs protruding from the wedge-shaped main body, a fastener-receiving hole being formed in each tab of the plurality of tabs.

16. The connector tactile sidewalk tile of claim 13, the upper surface of the connector flange being planar and configured for flush engagement with a bottom surface of an adjacent sidewalk tile.

17. The connector tactile sidewalk tile of claim 13, the wedge-shaped main body having first and second longitudinal sides, the connector flange adjoining the first longitudinal side of the wedge-shaped main body, the second longitudinal side of the wedge-shaped main body being free of an adjoining connector flange.

18. The connector tactile sidewalk tile of claim 13, an outer portion of the wedge-shaped main body being wider than an inner portion of the wedge-shaped main body, the outer portion of the wedge-shaped main body having a greater number of the truncated domes per unit length than the inner portion of the wedge-shaped main body.

19. The connector tactile sidewalk tile of claim 18, the truncated domes of the outer portion of the wedge-shaped main body being arranged in at least two rows, the truncated domes of the inner portion of the wedge-shaped main body being arranged in a single row.

20. The connector tactile sidewalk tile of claim 13, each of the plurality of truncated domes having a diameter of 0.9 inches and a height of 0.2 inches.

* * * * *